United States Patent [19]

Foster, Jr. et al.

[11] 4,220,363

[45] Sep. 2, 1980

[54] LATCH FOR METER BOX

[75] Inventors: Joseph J. Foster, Jr., Magnolia; Walter C. Schneider, North Canton, both of Ohio

[73] Assignee: Superior Switchboard & Devices Division of The Union Metal Manufacturing Co., Canton, Ohio

[21] Appl. No.: 34,296

[22] Filed: Apr. 30, 1979

[51] Int. Cl.[3] ..... E05C 1/12

[52] U.S. Cl. ..... 292/164

[58] Field of Search ..... 292/164, 307 R, DIG. 68, 292/189, 148; 220/277, 3.8; 49/394

[56] References Cited

U.S. PATENT DOCUMENTS

| | | | |
|---|---|---|---|
| 311,910 | 2/1885 | Moeller | 292/148 X |
| 1,131,403 | 3/1915 | Matthews | 292/189 |
| 2,120,145 | 6/1938 | Grace | 292/307 R X |
| 3,112,839 | 12/1963 | Hallbauer | 220/3.8 |
| 3,722,236 | 3/1973 | Zelenko | 292/DIG. 68 |

*Primary Examiner*—Richard E. Moore

*Attorney, Agent, or Firm*—Hamilton, Renner & Kenner

[57] ABSTRACT

Latch means (19) for locking a cover (10,110) on a meter box (11,111) against unauthorized opening and having a latch bar (32) slidably mounted on the inner surface of the cover behind an access opening (18,118) therein, said latch bar extending behind a flange (21,121) on the box when the cover is closed. The latch bar (32) has a cam portion 34 to ride over the flange (21,121) during closing of the cover and has an indentation forming a shoulder (38) adapted to be engaged by an implement (40) inserted through access opening (18,118) to raise the latch bar (32) and open the cover (10,110).

6 Claims, 7 Drawing Figures

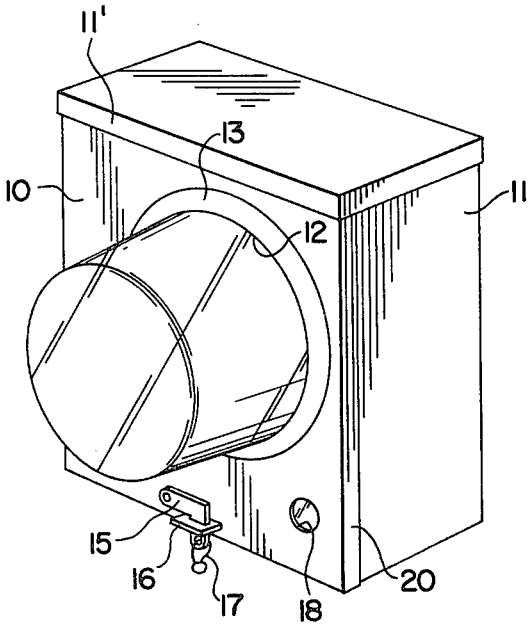
FIG. 1
FIG. 2
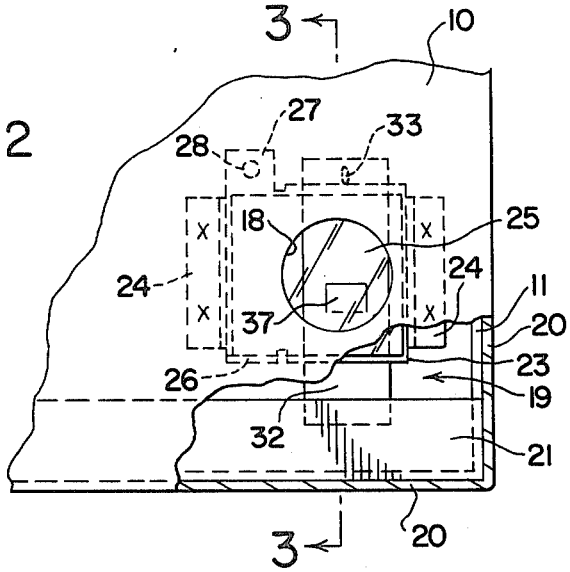

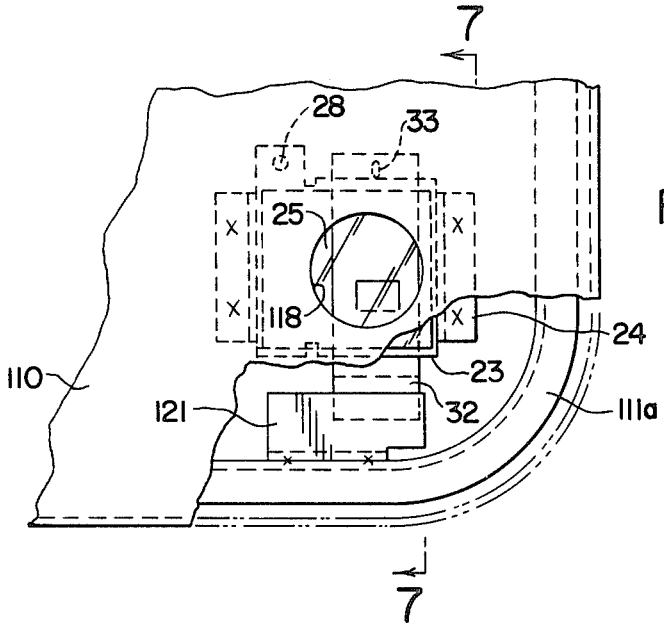
FIG. 6
FIG. 7
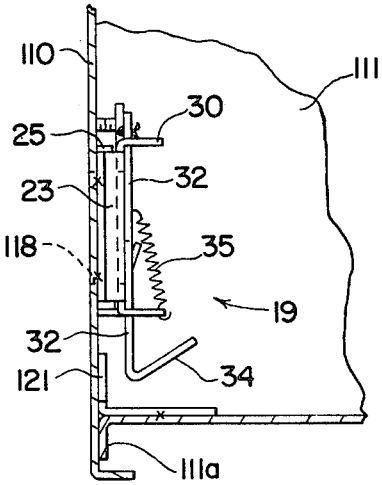

LATCH FOR METER BOX

TECHNICAL FIELD

The invention relates to boxes or housings for electric meters and related equipment, and more particularly to latch means for sealing such boxes to restrain unauthorized opening and afford detection of unauthorized opening attempts.

BACKGROUND ART

It is common practice for utility companies to locate meter boxes on the outside of the customer's house or building and connect the meter to the outside service lines ahead of interior switches, circuit breakers and the like, so as to discourage unauthorized diversion of power by the customer. These outdoor metal boxes have been provided with exterior latches having conventional seals which must be broken to open the box and are intended to show unauthorized tampering. However, ingenious tamperers have been able to restore or replace the broken seal so that it appears unbroken.

Prior U.S. Pat. No. 2,120,145 discloses a meter box having a rear body section and a front box-like cover section with interlocking latch means on the two sections for automatically locking the cover in closed position. An opening is provided in the cover providing access to the latch means and the opening is closed by a transparent sealing plate of glass or the like removable intact only from the interior of the cover and having an insignia of the power company on its inner surface. In order to open the box it is necessary to break the glass and insert a tool to release the latch means. An unauthorized person opening the box cannot replace the seal plate having the company insignia and hence an unauthorized opening of the box is readily detectable.

The interlocking latch means of said prior patent comprises an elongated spring hook secured at its rear end in the rear body section and extending forwardly into a tubular keeper on the cover having a slot to engage a lip on the hook, and the hook is disengageable by a tool inserted through the access opening in the front wall of the cover.

DISCLOSURE OF INVENTION

The present invention provides an improved latch means adapted for use with conventional boxes of relatively shallow depth wherein the cover is a flat lid with narrow peripheral flanges overlapping the front edges of the body section, and the usual transparent housing enclosing the meter may protrude through a sealed opening in the cover. This type of box is too shallow to accommodate the latch means of U.S. Pat. No. 2,120,145.

It is an object of the present invention to provide improved latch means on the inside of the front wall of a box cover adapted automatically to interlock with an upright flange at the front of the box when the cover is closed.

Another object is to provide a simple and inexpensive latch means mounted on the front wall of the cover and accessible through an opening therein.

A further object is to provide improved latch means mounted on the front wall of the box cover and easily adapted for use with various boxes already in service merely by applying it to or changing the box cover, and in certain cases by quickly attaching a flange piece to the front of the box if no front flange is present.

These and other objects are accomplished by the improvements comprising the present invention, a preferred embodiment of which is shown and described herein by way of example as setting forth the best known mode of carrying out the invention. Various modifications and changes in details of construction are comprehended within the scope of the appended claims.

BRIEF DESCRIPTION OF DRAWINGS

FIG. 1 is a front perspective view of a meter box embodying the improved latch.

FIG. 2 is an enlarged partial front elevation of a meter box showing a preferred embodiment of the improved latch means behind the access opening in the cover, part of the cover being broken away to show the flange on the body of the box normally interlocking with the latch bar.

FIG. 6 is a view similar to FIG. 2, showing the improved latch applied to the cover of a different style of meter box.

FIG. 7 is a sectional view on line 7—7 of FIG. 6.

DESCRIPTION OF PREFERRED EMBODIMENT

Figure 3:
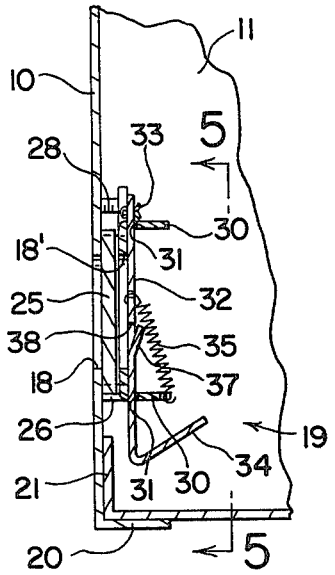
FIG. 3 is a sectional view on line 3—3 of FIG. 2.

Referring to FIG. 1, the front cover 10 of one type of meter box having a body 11 is provided with a circular opening 12 formed by a circumferential flange 13. The usual transparent dome 14 of the meter protrudes through the opening and a shoulder on the meter housing is sealed against the inner surface of flange 13 in a usual manner. A conventional latch 15 pivoted on the exterior of the cover is received in a keeper 16 extending through the cover and the usual sealed wire loop 17 extends through the end of the latch 15. The cover has a circular access opening 18 in its lower right corner and the top of the cover extends under a flange 11' on the top of the box when the cover is closed.

As shown in FIGS. 2–5, the improved latch means indicated generally at 19 is mounted on the inside of the cover 10 immediately behind the access opening 18. The cover has narrow inturned angular peripheral flanges 20 which are adapted to telescope over the front edges of the box body 11 when the cover is closed, and an upright flange 21 is provided along the lower edge of the box body for abutting the front wall of the cover 10 when the cover is closed.

The improved latch means 19 preferably embodies a bracket plate 23 spaced behind said access opening 18 and parallel to the front wall of the cover to provide a slot therebetween, and having side flanges 24 secured to the cover as by spot welding. The slot is open at the top of the bracket and is adapted to receive a frangible transparent seal plate 25 of glass or the like normally covering the opening 18. A retaining flange 26 is provided on the bracket at the bottom of the slot, and a vertical tab 27 at one side of the top of the bracket receives a retainer screw 28 for locking the plate in place after it is inserted in the slot. The bracket has an access opening 18' therein registering with opening 18, and the inside surface of plate 25 bears an insignia identifying the power company utilizing the box.

At the top and bottom edges of the bracket plate 23 are rearwardly directed angular guide flanges 30 having vertically aligned horizontal slots 31 therein disposed immediately behind the bracket plate. A latch bar 32 is vertically slidably received in said slots, and preferably has a cotter pin 33 in its upper end to limit downward movement of the latch bar by engaging the upper guide flange 30.

The bottom end of the latch bar 32 has a rearwardly upwardly inclined cam portion 34 adapted to engage the top edge of flange 21 of the box when the cover is swung to closing position. Preferably, a spring 35 having one end secured to the latch bar 32 and the other end secured to the lower guide flange biases the bar downwardly to its normal position behind flange 21 when the cover is closed. Behind the opening 18' the latch bar 32 is provided with an indentation as by punching a tang 37 rearwardly therein to form a shoulder 38 at the top of the indentation.

In use, the meter and its housing is installed in the box 11 by an authorized person representing the power company, the cover 10 having the improved latch means and seal plate is inserted at its top end under the box flange 11', and its lower end swung toward the box. When the cam portion 34 engages the upper edge of flange 21 it will cam upwardly, raising the latch bar against the bias of spring 35 to allow the bar to pass over the flange, whereupon the spring will drop the bottom end of the bar behind the flange 21 as seen in FIG. 3. The latch 15 may now be inserted through the keeper 16 and the seal 17 applied.

Figure 4:
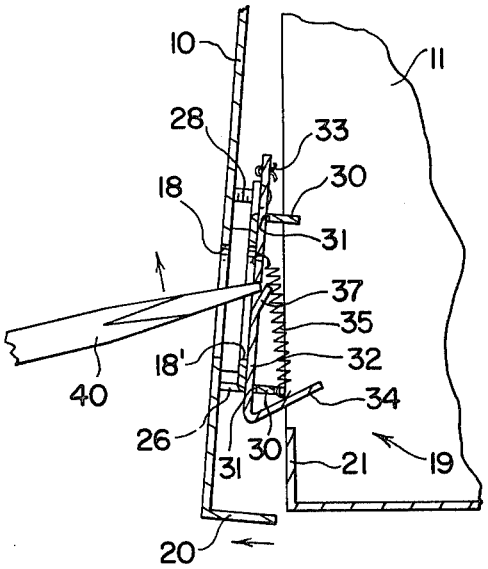
FIG. 4 is a similar view showing the latch held in released position by an inserted tool and the cover in opening position.
Figure 5:
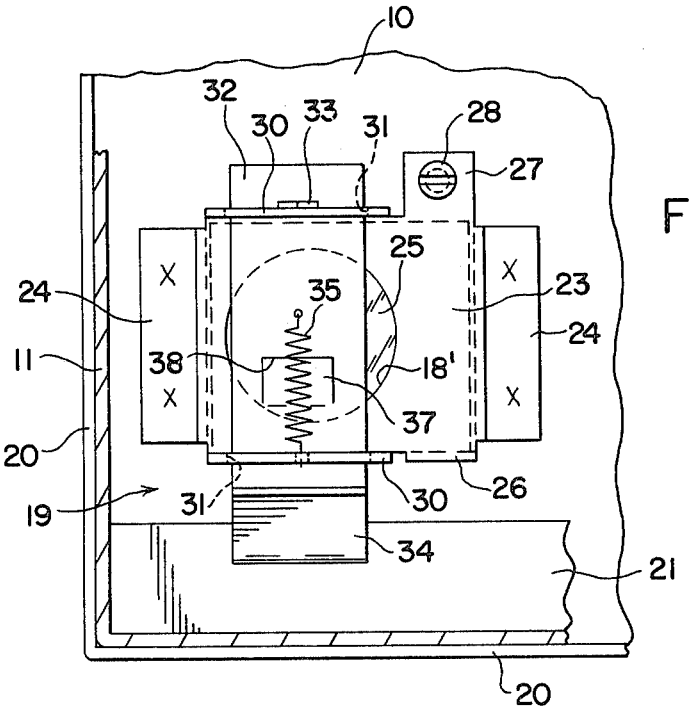
FIG. 5 is a further enlarged inside elevational view on line 5—5 of FIG. 3.

In order to open the cover, it is necessary to break the seal 17 and fracture the seal plate 25 sufficiently to allow an implement such as a screw driver 40 to be inserted as indicated in FIG. 4 to engage in the identation against the shoulder 38 and raise the bar to allow the bottom of the cover 10 to swing away from box to open position. If the box is opened by an unauthorized person, after first breaking the seal plate 25, such person will not have a seal plate bearing the company insignia available for replacement, and the absence of the proper seal plate immediately signals the unauthorized opening of the box.

Referring to FIGS. 6 and 7 showing the improved latch means applied to a different meter box construction, this style of box 111 is normally provided with an outturned peripheral flange 111*a* but has no upright flange along its bottom edge corresponding to the flange 21 on box 11.

In order to apply the improved latch means, it is necessary only to add an angular flange piece 121 below the access opening 118 in the cover 110, and this is easily accomplished by spot welding the horizontal portion of the piece to the bottom wall of the box so that the upright portion is located at the bottom of the front edge of the box in position to be engaged by the cam portion 34 of the latch bar during closing of the cover. In boxes where a knock-out slug in the bottom wall of the box is properly positioned with respect to the improved latch means, a similar flange piece may be bolted to the bottom wall, making sure that the bolt is locked against removal from the exterior of the box.

It will be apparent that the improved latch means is readily adapted for use with shallow meter boxes having substantially flat covers and may be constructed and installed with a minimum of labor and expense. The improved latch means is easily applied to various boxes of different construction which are already in service, with a slight modification or addition to such boxes.

We claim:

1. Latch means for locking a cover on a box against unauthorized opening, said cover having an access opening normally closed by a frangible plate on the inside of said cover and said box having an angular flange at its front periphery, said latch means comprising a latch bar slidably mounted on the inner surface of said cover proximate said access opening and adapted at one end to move behind said angular flange when the cover is closed, and a shoulder on said latch bar behind said access opening to receive the end of a tool inserted through said opening for moving said latch bar end from behind said flange.

2. Latch means as defined in claim 1, wherein a spring biases said latch bar end into position behind said flange.

3. Latch means as defined in claim 2, wherein said latch bar end has a cam portion for engaging said flange to move said end against the spring bias as the cover is closed.

4. Latch means as defined in claim 3, wherein a bracket on the inside of the cover mounts said frangible plate, and said latch bar is slidably mounted in said bracket behind said plate.

5. Latch means as defined in claim 1, wherein a bracket on the inside of the cover mounts said frangible plate, and said latch bar is slidably mounted in said bracket behind said plate.

6. Latch means as defined in claim 5, wherein a spring biases said latch bar into position behind said flange.

* * * * *